US007712541B2

(12) United States Patent
Loretz et al.

(10) Patent No.: US 7,712,541 B2
(45) Date of Patent: May 11, 2010

(54) SYSTEM AND METHOD FOR PROTECTING DOWNHOLE COMPONENTS DURING DEPLOYMENT AND WELLBORE CONDITIONING

(75) Inventors: Ives Loretz, Houston, TX (US); Donald Ross, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 647 days.

(21) Appl. No.: 11/555,404

(22) Filed: Nov. 1, 2006

(65) Prior Publication Data

US 2008/0099209 A1 May 1, 2008

(51) Int. Cl.
*E21B 33/12* (2006.01)

(52) U.S. Cl. ..... 166/387; 166/376

(58) Field of Classification Search ..... 166/387, 166/207, 376, 378

See application file for complete search history.

(56) References Cited

U.S. PATENT DOCUMENTS

| | | | | |
|---|---|---|---|---|
| 2,830,540 | A | 4/1958 | Vincent | |
| 5,310,000 | A | 5/1994 | Arterbury | |
| 5,320,178 | A | 6/1994 | Cornette | |
| 6,390,198 | B2 | 5/2002 | Brooks | |
| 6,394,185 | B1 | 5/2002 | Constien | |
| 6,431,282 | B1 * | 8/2002 | Bosma et al. | 166/288 |
| 6,655,459 | B2 | 12/2003 | Mackay | |
| 6,766,862 | B2 * | 7/2004 | Chatterji et al. | 166/381 |
| 6,769,484 | B2 * | 8/2004 | Longmore | 166/207 |
| 6,831,044 | B2 | 12/2004 | Constien | |
| 6,935,432 | B2 * | 8/2005 | Nguyen | 166/387 |
| 6,971,450 | B2 | 12/2005 | Mackay | |
| 7,059,410 | B2 | 6/2006 | Bousche | |
| 7,228,915 | B2 * | 6/2007 | Thomson | 166/387 |
| 2004/0231845 | A1 | 11/2004 | Cooke | |
| 2005/0067170 | A1 * | 3/2005 | Richard | 166/387 |
| 2005/0199401 | A1 | 9/2005 | Patel | |
| 2006/0272806 | A1 | 12/2006 | Wilkie | |
| 2007/0181224 | A1 * | 8/2007 | Marya et al. | 148/400 |

* cited by examiner

*Primary Examiner*—Daniel P Stephenson
(74) *Attorney, Agent, or Firm*—Rodney V. Warfford; Daryl R. Wright; Robert Van Someren PC

(57) ABSTRACT

A technique is provided to temporarily protect well system components during transport, movement downhole and/or initial downhole operations. A sacrificial material is formed as a protective sacrificial element disposed proximate susceptible well system components. The protective sacrificial element is at least partially dissolvable in fluids within a wellbore to facilitate removal of the element after a desired time period. Once the temporary, protective sacrificial element is removed, the protected well system component is fully operable.

16 Claims, 4 Drawing Sheets

SYSTEM AND METHOD FOR PROTECTING DOWNHOLE COMPONENTS DURING DEPLOYMENT AND WELLBORE CONDITIONING

BACKGROUND

Moving well equipment downhole into a wellbore during an installation process can have damaging effects on a variety of equipment components. This is particularly true of fragile components, sealing components and components susceptible to bending. Such components can be damaged from impacts with the surrounding wellbore, casing, liner or open hole barefoot sections. The impacts can create abrasions or other damage that limits the functionality of the equipment once positioned downhole. Damage also can result from erosion of component material or contamination of the component in a manner that effects its operation.

In some applications, downhole equipment components comprise seal elements used to form a seal with other components or with the surrounding wellbore wall, e.g. casing. The seal elements can be damaged as they slide through hundreds or thousands of feet of casing before reaching the final downhole destination. Because the seal elements are formed of a plastic or otherwise softer material, impacts with the surrounding wellbore wall, obstructions or other equipment can damage one or more seal elements and limit the ability of the seal elements to form a satisfactory seal downhole.

SUMMARY

In general, the present invention provides a technique for protecting components of a well system from damage. Sacrificial material is deployed proximate a susceptible wellbore component to provide temporary protection of the component. The sacrificial material is used to protect wellbore system components during installation of the system to a downhole location. For example, the material can protect susceptible wellbore components from damage due to impacts. However, the sacrificial material also can temporarily protect wellbore components from other potentially damaging effects of the harsh wellbore environment during installation of the system.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variation or modifications from the described embodiments may be possible.

The present invention relates to a system and methodology for shielding sensitive well components during, for example, installation operations and early production phases. The potential for damaging well components during a run-in into a wellbore is great, particularly for relatively fragile components, such as seals. Accordingly, the present system and methodology provides temporary protection against impact, e.g. abrasion, erosion, contamination and other environmental effects that can damage sensitive well components. In many applications, the protection is provided as the well components slide through several hundreds or thousands of feet of well casing before reaching their final wellbore destination.

Figure 1:
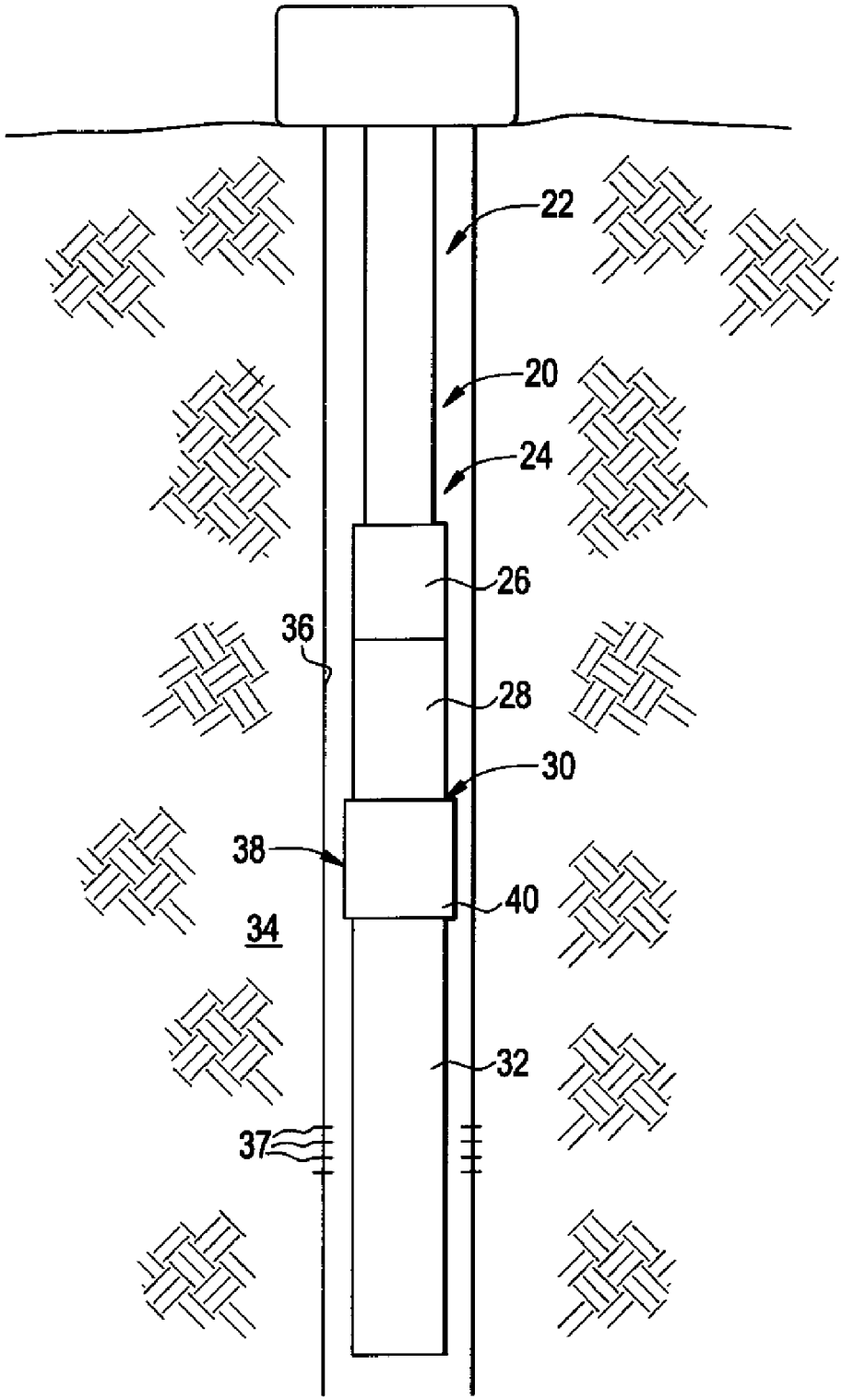
FIG. 1 is an elevation view of an embodiment of a well equipment system, having at least one susceptible component, as the well equipment system is moved downhole into a wellbore, according to an embodiment of the present invention.

Referring generally to FIG. 1, an embodiment of a well system 20 is illustrated as it is installed into a wellbore 22. However, well system 20 also could be positioned at a desired location during, for example, an early production phase. By way of example, well system 20 may comprise a completion 24 having a plurality of well components 26, 28, 30 and 32.

In the example illustrated, submersible pumping system 20 is designed for deployment in wellbore 22 which has been drilled into a geological formation 34 containing desirable production fluids, such as petroleum. In at least some applications, wellbore 22 is lined with a wellbore casing 36. A plurality of perforations 37 is formed through wellbore casing 36 to enable flow of fluids between the surrounding formation 34 and the wellbore 22.

At least one of the well components, e.g. well component 30, is protected by a sacrificial protection element 38, such as a temporary covering 40 positioned around well component 30. In this embodiment, the sacrificial protection element 38 protects the component from damage due to abrasion, erosion, contamination or other damage resulting from movement through the wellbore and/or initial operation of the well system 20. The illustrated temporary covering 40 is at least partially formed of a dissolvable material to enable selective exposure of well component 30 at a desired time within wellbore 22. Accordingly, one or more well components 30 can be protected with temporary covering 40 during run-in of well system 20 and/or during initial startup procedures once well system 20 is positioned at a desired location within wellbore 22. Subsequently, the temporary covering 40 is automatically removed to expose the one or more well components 30 for appropriate operation within the wellbore.

Well component 30 may comprise a variety of components useful in well operations, such as electrical components, e.g. sensors or controls, control lines, seal bores, or flexible elements, such as seal elements. Many seal elements are formed of rubber materials, plastic materials or other relatively soft and/or flexible materials that are susceptible to abrasion and other damage, particularly during run-in of well system 20. The temporary covering 40 is particularly amenable to protecting such seal materials from impacts along the wellbore that can lead to abrasion or other damage to the seal material, thereby limiting the ability of component 30 to form a desired seal. Sacrificial covering 40 also can be used to shield sensitive components from particle contamination until the components are called upon to perform. Covering 40 also can be used to temporarily fix, e.g. secure, components during installation procedures until covering 40 is removed to allow the desired freedom of movement for the component.

Temporary covering 40 may be applied to component or components 30 at various times during the installation process. For example, covering 40 can be wrapped around or otherwise mounted adjacent component 30 before being transported along the surface to the well site at which wellbore 22 has been formed. In this matter, covering 40 can be used to protect the one or more components 30 both before and during installation of well system 20. Even if protection is not required during run-in, applying covering 40 before surface transport avoids the time and cost otherwise associated with removing covering 40, because the covering 40 is automatically removed from the component 30 as it is submerged and dissolves within wellbore 22. Accordingly, protection is maintained until the last possible moment, and rig time is reduced, because no disassembly is required. In some applications, the material and thickness of temporary covering 40 is selected so dissolving of the dissolvable material, and the consequent removal of covering 40 from component 30, requires a slightly longer period of time than that necessary to run well system 20 to its final depth in wellbore 22.

Figure 2:
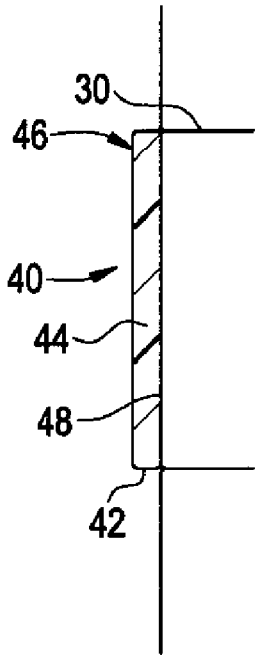
FIG. 2 is a partial cross-sectional view of an embodiment of a sacrificial element used to protect one or more components of the well equipment system illustrated in FIG. 1, according to an embodiment of the present invention.
Figure 3:
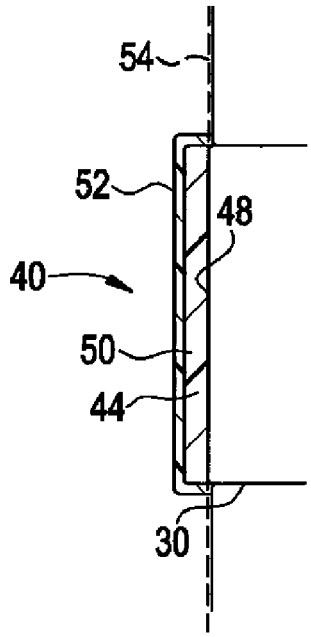
FIG. 3 is a partial cross-sectional view of another embodiment of the sacrificial element used to protect one or more components of the well equipment system illustrated in FIG. 1, according to an embodiment of the present invention.
Figure 4:
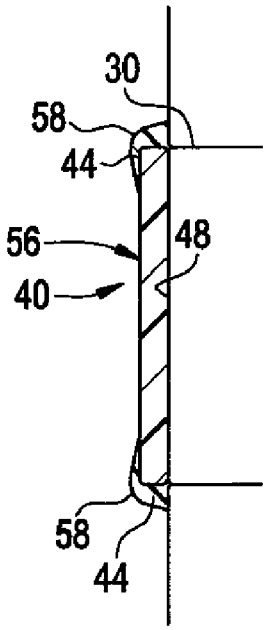
FIG. 4 is a partial cross-sectional view of another embodiment of a sacrificial element used to protect one or more components of the well equipment system illustrated in FIG. 1, according to an embodiment of the present invention.

In FIGS. 2-4, examples of temporary coverings 40 are illustrated. Referring first to FIG. 2, an embodiment of temporary covering 40 comprises a layer 42 having sufficient thickness to protect component 30 from damage due to impacts with the wall of wellbore 22. In this embodiment, the thickness of layer 42 is greater than the thickness of a coating and is designed to cushion component 30 against potential impacts during run-in. Layer 42 is formed of a dissolvable material 44 selected to dissolve at a desired rate when exposed to well fluid within wellbore 22. Accordingly, the dissolving of temporary covering 40 is controlled by submerging dissolvable material 44 in fluids found within wellbore 22 during movement of well system 20 to a desired location within the wellbore. Alternatively, fluid agents also can be added to the wellbore to control the dissolving of material 44.

Layer 42 may be formed as a sleeve 46 that encircles component 30 about its longitudinal axis. In many applications, layer 42 is disposed proximate component 30 and between component 30 and potentially damaging structures, such as the wellbore wall formed by casing 36. In fact, layer 42 can be adhered directly to an outer surface 48 of component 30, regardless of whether layer 42 is formed as a sleeve 46 or in some other structural form.

In FIG. 3, temporary covering 40 comprises an inner layer 50 formed of dissolvable material 44. Inner layer 50 is covered by a coating 52 designed to prevent exposure of dissolvable material 44 to dissolving fluids until a desired time during the well system installation or operation procedure. Coating 52 can be degraded or otherwise removed by providing an appropriate input downhole. For example, coating 52 can be selected such that it is sensitive to heat. In this embodiment, once the coating 52 is exposed to sufficient heat at a desired depth within wellbore 22, the coating is degraded which exposes inner layer 50 to well fluids able to dissolve inner layer 50. In another embodiment, coating 52 can be designed to degrade under sufficient pressure provided either naturally at certain wellbore depths or artificially by applying pressure to the wellbore from, for example, a surface location. In other embodiments, coating 52 can be designed to degrade when exposed to specific chemicals directed downhole. In any of these embodiments, coating 52 prevents the disappearance of inner layer 50 until a specific time period in which the pressure or temperature, for example, causes coating 52 to fail, thus initiating dissolving of inner layer 50. Once inner layer 50 is dissolved, component 30 is exposed for operation. In this embodiment and other embodiments, the one or more components 30 may comprise a control line 54 that is protected in whole or in part by temporary covering 40.

Referring generally to FIG. 4, another example of protective covering 40 is illustrated. In this embodiment, protective covering 40 is formed of a durable sleeve 56 held in place adjacent component 30 by dissolvable structural elements 58. Durable sleeve 56 is formed of a material that does not dissolve in well fluids, such as a non-dissolvable elastomeric material. Accordingly, when component 30 of well system 20 is moved into wellbore 22 and submerged in well fluid, dissolvable structural elements 58 dissolve and release durable sleeve 56. At this stage, durable sleeve 56 simply slides away from component 30 to enable proper operation of component 30.

Dissolvable material 44 and coating 52 can be formed from a variety of materials depending on the specific application and environment in which it is used. For example, the materials selected may vary depending on the potential heat and pressures in a given wellbore environment. The materials selected also may depend on the types of well fluids encountered in a given wellbore environment. Examples of dissolvable material 44 comprise highly reactive metals such as calcium, magnesium or alloys thereof, or materials that dissolve in acidic or basic fluids, e.g. aluminum, polymers or specially formulated plastics. Examples of suitable materials used to form coating 52 comprise aluminum or other metals that can be removed with acid or specifically formulated chemicals. Other examples of materials comprise low-temperature plastics or elastomers that fail at higher pressures or temperatures. Additional examples of suitable materials comprise metallic coatings that differ greatly in thermal expansion coefficient relative to their carrier material, such that the coating material fractures and breaks away at elevated temperatures.

Figure 5:
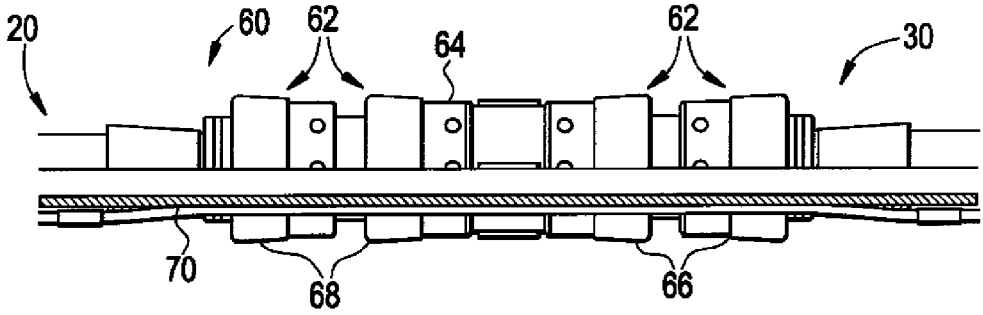
FIG. 5 is a side view of the one example of a potentially susceptible wellbore component having seal elements, according to an embodiment of the present invention.
Figure 6:
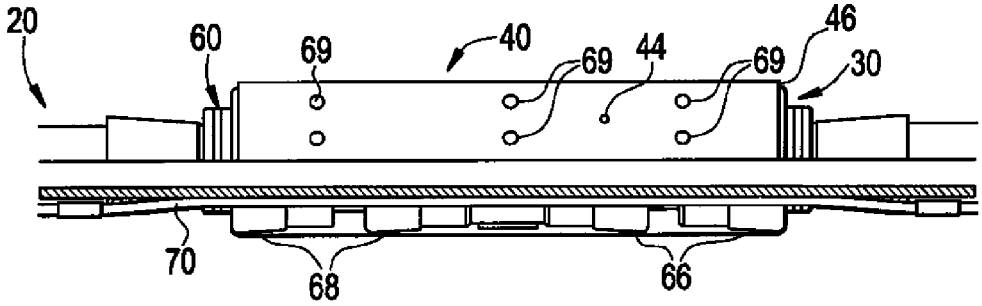
FIG. 6 is a side view similar to that of FIG. 5 showing a sacrificial element deployed adjacent the wellbore component, according to an embodiment of the present invention

Referring to FIGS. 5 and 6, a specific example of one type of component 30 that is particularly amenable to installation with temporary covering 40 is illustrated. In this embodiment, well component 30 comprises a packer 60 having one or more seal elements 62 positioned to form a seal within wellbore 22. For example, seal elements 62 may be used to form a seal between a packer body 64 and well casing 36. In the example illustrated, packer 60 comprises four seal elements 62 that include two downward facing cup seal elements 66 and two upward facing cup seal elements 68, as best illustrated in FIG. 5. For some applications, seal elements 62 are designed in a manner that creates a slight interference against well casing 36, thus increasing the potential for damage to the seal elements as they slide through several hundreds or several thousands of feet of wellbore casing 36 before reaching the final packer destination.

To prevent damage to seal elements 62 and to protect the functionality of packer 60, covering 40 is applied over well component 30, as illustrated in FIG. 6. Temporary covering 40 provides a protective barrier between seal elements 62 and the surrounding well casing 36 when component 30 is run downhole. A plurality of holes or penetrations 69 may be added to temporary covering 40 to facilitate pressure equalization during run-in and/or during initial pressure cycles. The covering 40 slides along the wellbore wall and serves as a sliding contact to protect the seal elements from the wellbore wall. In the embodiment illustrated in FIG. 6, covering 40 can be constructed in the form of sleeve 46 constructed of dissolvable material 44, as generally illustrated in greater detail in FIG. 2. However, the example illustrated in FIG. 6 also can utilize other embodiments of covering 40, such as those illustrated in greater detail in FIGS. 3 and 4, to protect the one or more seal elements 62. In this application, temporary covering 40 is designed to protect component 30 and seal elements 62 at least until packer 60 is located at a desired wellbore position for engagement with wellbore casing 36. After temporary covering 40 dissolves and seal elements 62 are exposed, packer 60 can be actuated to move seal elements 62 against casing 36. It should be noted that packer 60 may cooperate with other well system components, such as one or more control lines 70 extending longitudinally through the packer.

Figure 7:
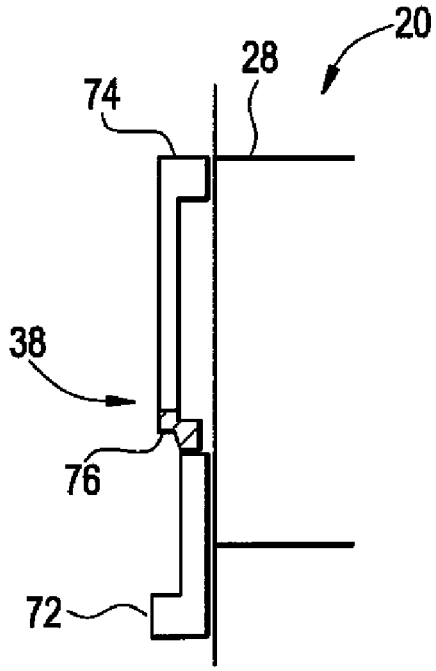
FIG. 7 is a partial cross-sectional view of another embodiment of a sacrificial element used to protect one or more components of the well equipment system illustrated in FIG. 1 from premature actuation by temporarily locking the one or more components in a desired state, according to an embodiment of the present invention.
Figure 8:
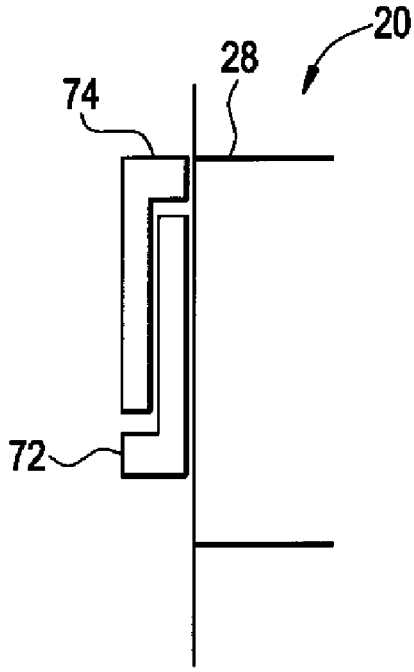
FIG. 8 is a partial cross-sectional view similar to that of FIG. 7 but showing the one or more components actuated following removal of the sacrificial element, according to an embodiment of the present invention.

Another embodiment of sacrificial protection element 38 is illustrated in FIGS. 7 and 8. In this embodiment, well system 20 comprises a component, e.g. component 28, having one or more movable parts 72 and one or more fixed parts 74. Sacrificial protection element 38 is in the form of a temporary element 76 that protects component 28 from premature actuation during transport, running-in hole, or early operation. The temporary element 76 is a dissolvable component that temporarily blocks movement of movable part 72 relative to fixed part 74, thereby ensuring specific functions of well component 28 become available only after a predetermined amount of time or after other triggering mechanisms have initiated dissolving of temporary element 76. Once the sacrificial protection element 38 (temporary element 76 in this embodiment) is dissolved, the component can be actuated by relative movement of parts 72 and 74, as illustrated best in FIG. 8. Temporary element 76 can be used to replace, for example, shear shrews or other mechanical locking mechanisms currently used to hold components temporarily in place during transport, run-in, or the early production phase of an operation.

The specific components used in well system 20 can vary depending on the actual well application in which the system is used. Similarly, the specific component or components 28, 30 protected by sacrificial protection element 38 can vary from one well application to another. Additionally, the specific configuration and formulation of element 38 can be adapted to the specific component covered or otherwise protected, the environmental factors associated with the given well application, and other design considerations. Regardless, sacrificial protection element 38 is designed with sufficient material thickness to provide the component with protection against damage due to impacts and other well related characteristics experienced during the run-in and initial startup procedures and/or with protection against premature actuation of a component before its intended use downhole.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A method of deploying a component downhole into a wellbore, comprising:

protecting a sealing element of a wellbore component with a dissolvable material able to protect the sealing element during movement downhole;

moving the wellbore component into the wellbore;

dissolving the dissolvable material within the wellbore to expose the sealing element; and forming a plurality of penetrations through the dissolvable material to enable pressure equalization during movement downhole.

2. The method as recited in claim 1, wherein protecting comprises placing a sleeve of the dissolvable material around the sealing element.

3. The method as recited in claim 1, wherein protecting comprises placing a durable sleeve over the sealing element and temporarily holding the durable sleeve in place with the dissolvable material.

4. The method as recited in claim 1, wherein dissolving comprises maintaining the wellbore component in a wellbore fluid until dissolved.

5. The method as recited in claim 1, wherein protecting comprises covering a plurality of the sealing elements during movement downhole.

6. The method as recited in claim 1, wherein protecting comprises covering a packer element during movement downhole.

7. The method as recited in claim 1, wherein protecting comprises covering a cup-type packer element during movement downhole.

8. The method as recited in claim 1, wherein protecting comprises covering the dissolvable material with a coating that is degradable upon a specific input.

9. A method of protecting a component to be moved downhole, comprising:

selecting a material able to dissolve within a wellbore environment after a desired length of time;

covering a wellbore component with the material to protect the wellbore component when it is moved downhole;

covering the material with a coating that is degradable upon a specific input;

providing the combination of the material and the coating with a sufficient thickness to prevent contact between the wellbore component and a surrounding wellbore wall; and locating at least one hole through the material to enable pressure equalization between a plurality of sides of the material during movement downhole.

10. The method as recited in claim 9, further comprising transporting the wellbore component to a well site in a covered state; moving the wellbore component into a wellbore; providing the specific input to degrade the coating; waiting for the material to dissolve; and operating the wellbore component.

11. The method as recited in claim 9, wherein the is degradable under sufficient temperature.

12. The method as recited in claim 9, wherein the coating is degradable under sufficient pressure.

13. A method, comprising:

constructing a well equipment string with a well component having a plurality of parts that are movable with respect to each other during an actuation of the well component;

temporarily blocking relative movement of the plurality of parts with a dissolvable element;

dissolving the dissolvable element; and selectively actuating the well component by initiating relative movement of the plurality of parts after dissolving the dissolvable element.

14. The method as recited in claim 13, further comprising running the well equipment string into a wellbore.

15. The method as recited in claim 14, further comprising dissolving the dissolvable element in the wellbore.

16. The method as recited in claim 15, further comprising actuating the well component after the dissolvable element is dissolved.

* * * * *